United States Patent [19]

Welsch et al.

[11] Patent Number: 4,756,055

[45] Date of Patent: Jul. 12, 1988

[54] HINGE JOINT

[75] Inventors: Franz-Peter Welsch, Mechernich; Fritz Otto, Remscheid; Friedhelm Bick, Solingen, all of Fed. Rep. of Germany

[73] Assignee: Carl Sülberg GmbH & Co., Remscheid, Fed. Rep. of Germany

[21] Appl. No.: 938,790

[22] Filed: Dec. 5, 1986

[30] Foreign Application Priority Data

Dec. 7, 1985 [DE] Fed. Rep. of Germany ... 8534442[U]

[51] Int. Cl.[4] ..... E05D 7/10; E05D 1/04

[52] U.S. Cl. ..... 16/260; 16/262; 16/356

[58] Field of Search ..... 16/229, 260, 262, 355, 16/356, 266

[56] References Cited

U.S. PATENT DOCUMENTS

| | | | |
|---|---|---|---|
| 770,595 | 9/1904 | Lovette | 16/260 |
| 2,677,147 | 5/1954 | Phillips | 16/266 |
| 2,742,664 | 4/1956 | Weiner | 16/356 |
| 4,603,452 | 8/1986 | Paciorek | 16/262 |

FOREIGN PATENT DOCUMENTS

| | | | |
|---|---|---|---|
| 2317039 | 10/1974 | Fed. Rep. of Germany | 16/260 |
| 3245205 | 7/1983 | Fed. Rep. of Germany . | |

*Primary Examiner*—Nicholas P. Godici
*Assistant Examiner*—Samuel M. Heinrich
*Attorney, Agent, or Firm*—Michael J. Striker

[57] ABSTRACT

A hinge joint comprises a hinge leaf, a closure element, a knuckle bearing, a hinge bolt defining a hinge joint axis and pivotally mounting the closure element via the knuckle bearing, a hinge bearing having a base securable adjacent to an edge of an opening, the hinge bearing having legs between which the knuckle bearing is positioned and which carries the hinge bolt, the knuckle bearing having at least one first protrusion extending axially outwardly and arranged concentrically relative to the hinge bolt, one of the legs having an axially inwardly extending protrusion which axially overlaps the first protrusion, the hinge leaf together with the closure element being arranged so that it can be removed from the hinge bearing only after removal of the hinge bolt and after opening the closure element through a predetermined pivot angle, the first protrusion being annular, the second protrusion being formed as an enclosing retainer of one of the legs and arranged radially outside of one of the first protrusions, the enclosing retainer at at least one side face of the leg being provided with an access passage for the first protrusion, and cam means provided on the hinge leaf, so that only in a pivoted position of the closure element is a minimum dimension of the cam means extending perpendicular to the hinge joint axis with the hinge bolt removed, so that the passage of the first protrusion through an associated one of the access passages is possible.

9 Claims, 5 Drawing Sheets

Fig. 5
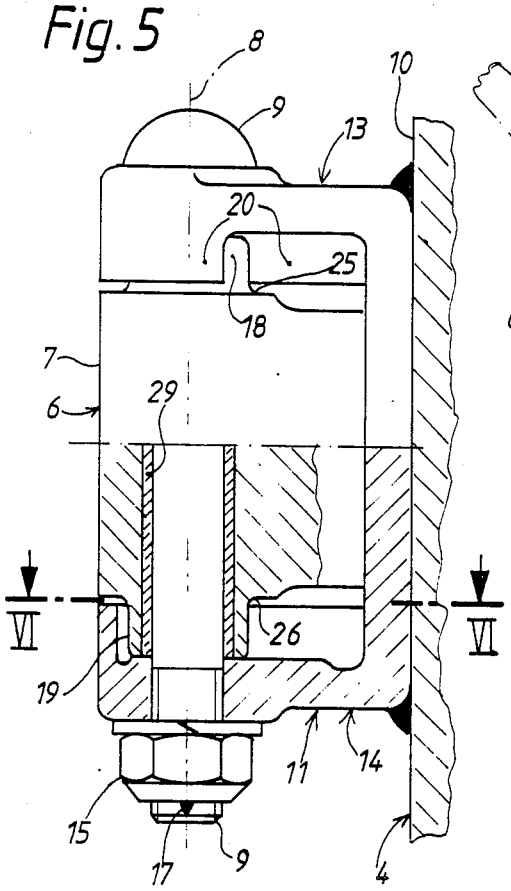
Fig. 6
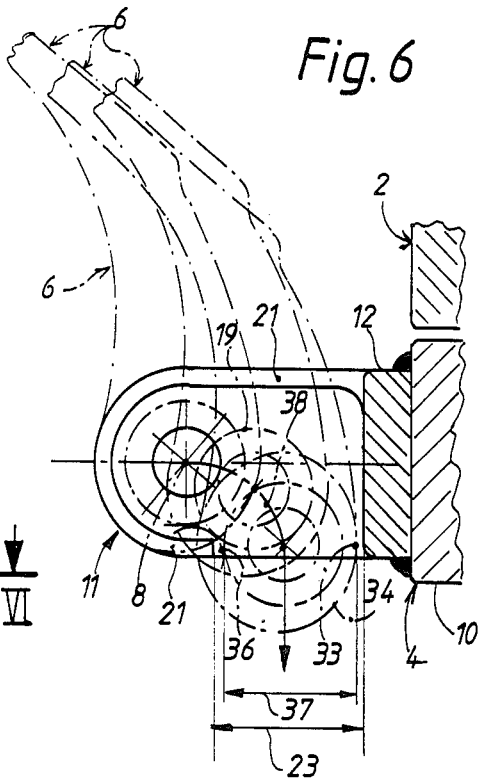
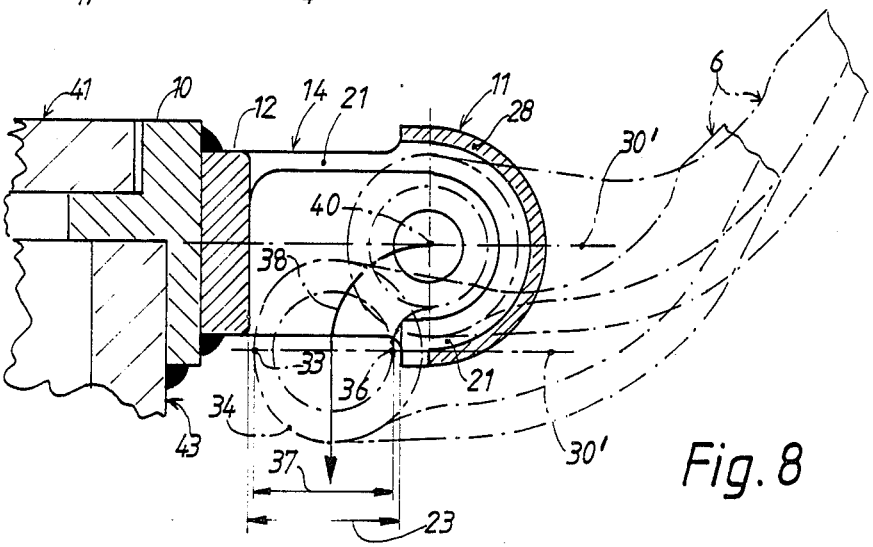
Fig. 8

HINGE JOINT

BACKGROUND OF THE INVENTION

The present invention relates to a hinge joint, particularly for closure elements such as doors and the like, for openings of containers, vehicles, holding tanks etc.

Door hinge joints of the above mentioned type are known in the art. One known door hinge joint is disclosed in the German patent document DE-OS No. 3,245,205. This document describes a door hinge joint which has a vertical hinge joint axis and custom security means. Two protrusions are provided of which a first protrusion is formed as a shell, and a second protrusion is formed circularly cylindrical. When the door is closed each shell engages beneath the associated cylindrical second protrusion. With a hinge bolt removed, the shells can come free even after comparatively small opening movement of the door panel without engagement with the second protrusions. Thus, the operating personnel are in danger, since the door panel can tilt and fall prematurely. This can cause damage to the hinges, door panel and door frame.

SUMMARY OF THE INVENTION

Accordingly, it is an object of the present invention to provide a hinge joint which avoids the disadvantages of the prior art.

More particularly, it is an object of the present invention to provide a hinge joint which is secure against unauthorized opening of a closure element, which guarantees custom security and security against tampering and theft, and in which the operational safety of the hinge joint with the hinge bolt removed is greater than in known hinge joints.

In keeping with these objects and with others which will become apparent hereinafter, one feature of the present invention resides, briefly stated, in a hinge joint with a closure element having a knuckle bearing on a hinge bolt, and a hinge bearing secured by its base near an opening and comprising legs between which the knuckle bearing is arranged and which carry the hinge bolt, wherein at least one first protrusion which extends axially outwardly from the knuckle bearing is annular, at least one second protrusion extending axially inwardly from one of the legs is formed as an enclosing retainer of the associated leg and arranged radially outside the associated first protrusion, the enclosing retainer at least at one side face of the leg is provided with an access passage for the associated first protrusion, and cam means are provided on the hinge leaf so that only in a pivoted postion of the closure element corresponding to a predetermined first pivot angle there is a minimum dimension of the cam means extending perpendicular to the hinge joint axis with the hinge bolt removed, which permits passage of the first protrusion through the associated access passage.

In this construction any angle of inclination of the hinge joint axis and in particular a horizontal or vertical arrangement of it can be realized. The hinge joint in accordance with the present invention is suitable equally well for doors and lids of containers, vehicles and holding tanks. The hinge joint in accordance with the invention provides for capability for custom inspection. A custom official can have completely unhindered sight into the hinge components which provide custom security. Tampering with these components can be seen without difficulty by the custom officer from outside.

Because of the good possibilities of inspection of the hinge, a high security against unauthorized opening of the closure element is achieved, against tampering and theft in particular. Moreover, the operating reliability of the inventive hinge joint is considerably increased. The hinge leaf and consequently the door panel or lid secured to it is secured against falling from the hinge bearing unintentionally when the hinge bolt is removed, over the greater part of its possible range of pivotal movement. This reliability is a result of the special relative shape of the first and second protrusions and their cooperation with the cam means. In practice, one can achieve the situation that the door panel or the cover can be withdrawn from the hinge bearing or fitted in the hinge bearing only within a first pivot angle which is determined with a relatively small tolerance. This predetermined first pivot angle is known to the operating personnel so that with the hinge bolt removed, particular care on the part of the operating personnel is necessary during fitting or removal of the door panel or cover only when the door panel or cover lies within this predetermined first pivot angle.

In accordance with another advantageous feature of the present invention, the first protrusions can be made annular, while the cam preferably extends over the full axial length of the knuckle bearing as far as the first protrusions. In this construction a reliable clamping lock is provided over the whole range of pivotal movement of the door panel or cover, with the inclusion of the above mentioned predetermined first pivot angle in which the fitting and removal of the closure element take place.

Still another feature of the present invention is that a cam is arranged on the first protrusion and in the pivot position of the closure element corresponding to the first angle the minimum defined by the cam is at least approximately parallel to the access passage. This construction makes possible a particularly simple configuration of the knuckle bearing with equal functional reliability.

The hinge joint is formed in accordance with the present invention so that with the hinge bolt inserted, at least a peripheral zone spaced from the base of the hinge bearing on a transition portion from the knuckle bearing to the first protrusion is shielded by a protective rim of the associated enclosing retainer of the hinge bearing. This provides for an additional security against unauthorized tampering, particularly by sawing across the transition portion.

Another feature of the present invention is that with the hinge bolt inserted, there is a spacing between the hinge joint axis and the base of the hinge bearing, which is greater than the minimum dimension. In this construction the operational reliability is further improved. Fitting and removal of the hinge leaf must take place relative to the hinge bearing by following a path of movement which involves a change of direction. On the one hand, this increases the concentration of the operational personnel and on the other hand prevents unintentional falling of the closure element from the hinge bearing.

The hinge joint of the invention can be provided with a bearing sleeve between the hinge bolt, on the one hand, and the knuckle bearing and the first protrusion, on the other hand. The bearing sleeve can be composed of a bearing metal or a plastic textile material. The material of the bearing sleeve is selected with the practical operational requirements.

Still a further feature of the present invention is that the hinge joint is formed so that with the horizontal hinge joint axis the access passage at the respective leg of the hinge bearing is open only upwardly. This increases the operation reliability. With the hinge bolt removed, the closure element can not drop uncontrollably from the hinge bearing. It must be pushed upwardly from the hinge bearing or be set into the hinge bearing from above. It is therefore insured that the closure element is securably held in place until the hinge bolt is fitted and secured.

The enclosing retainer of the hinge joint in accordance with the invention can be formed as a continuous member. This insures high operational reliability and in most cases sufficient accessibility for inspection by custom officials.

Another feature of the present invention is that each enclosing retainer has two portions provided on the second protrusion, in which peripheral apertures are formed by the periphery of the associated leg. The width of each peripheral aperture is smaller than the minimum dimension of the associated first protrusion perpendicularly to the hinge joint axis. In this construction the visual inspection is easier for those who have to carry it out. Moreover, unintentional dropping of the closure element with the hinge bolt removed is prevented, particularly when with a horizontal hinge joint axis the access passage is open upwardly.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 5 is a view substantially corresponding to the view of FIG. 4, but showing a hinge joint in accordance with another embodiment of the present invention with a vertical hinge joint axis;

FIG. 6 is a view showing a section of the hinge joint of FIG. 5, taken along the line VI—VI in FIG. 5;

FIG. 8 is a view substantially corresponding to the view of FIG. 3, but showing a section through the hinge bearing of the hinge joint of FIG. 7;

DESCRIPTION OF PREFERRED EMBODIMENTS

Figure 1:
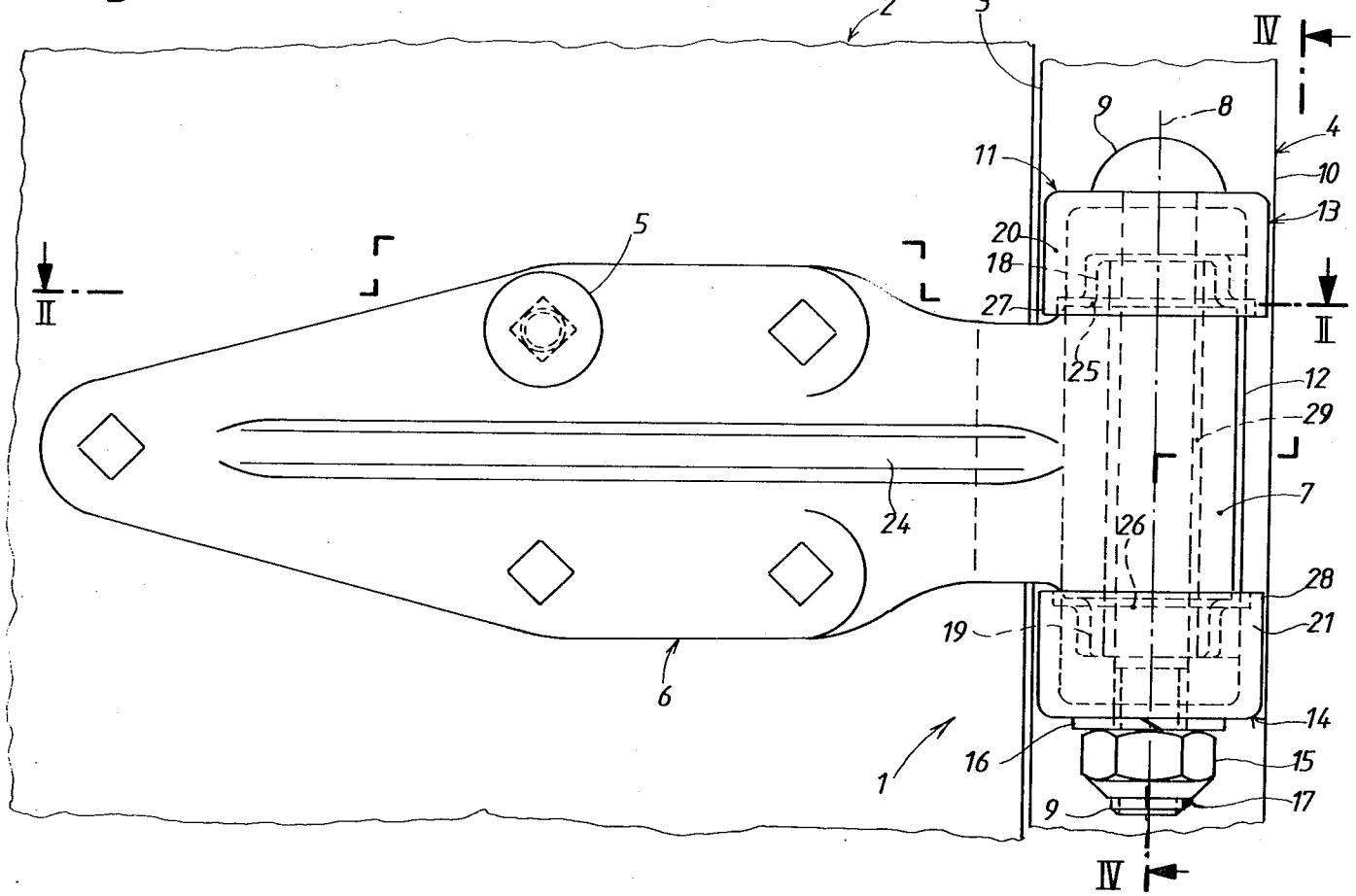
FIG. 1 is a plan view of a hinge joint with a vertical hinge axis.

A hinge joint in accordance with the present invention shown in FIG. 1 is identified as a whole with reference numeral 1. It is used for a closure element 2 which in this case is formed as a door panel, for an opening 3 of a container 4. The hinge joint has a hinge leaf 6 which is secured to the closure element 2 by means of round-headed square-shouldered screws 5 formed in accordance with the German standard DIN 603. Only one of the screws is shown in FIG. 1. The hinge leaf 6 is pivotally mounted on a hinge bolt 9 by means of a knuckle bearing 7. The hinge bolt 9 defines a hinge joint axis 8.

Figures 2, 3, 4:
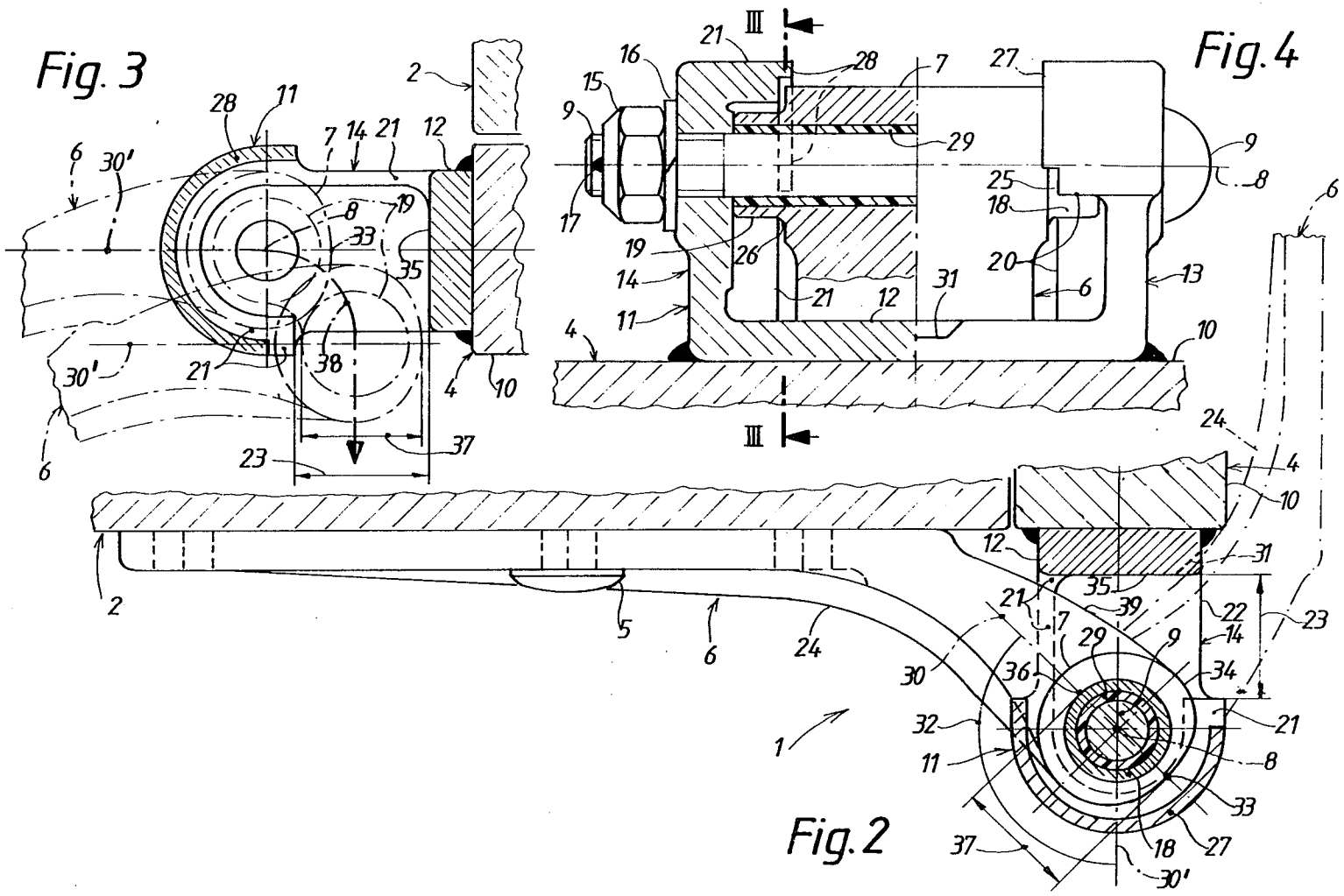
FIG. 2 is a view showing a section of the hinge joint of FIG. 1, taken along the line II—II of FIG. 1.
FIG. 3 is a view showing a section of the hinge joint of FIG. 1 taken along the line III—III in FIG. 4.
FIG. 4 is a view showing a section of the joint of FIG. 1, taken along the line IV—IV in FIG. 1 and turned by 90° in clockwise direction relative to that of FIG. 1.

A hinge bearing 11 has a base 12 and is welded at the edge of the opening 3 to a frame 10 of the container 4. The hinge bearing 11 has legs 13 and 14 which carry the hinge bolt 9. The knuckle bearing 7 is positioned between the legs 13 and 14 of the hinge bearing 11. The hinge bolt 9 has a nut 15 which is secured in place by a spring ring 16 and a weld point 17. The knuckle bearing 7 comprises two axially outwardly extending annular first protrusions which are formed as stubs 18 and 19 and arranged concentrically about the hinge bolt 9. The legs 13 and 14 are provided each with an axially extending second protrusion formed as shoulders 20 and 21 and axially overlapping the associated projecting stubs 18 and 19. Each of the shoulders 20 and 21 is formed as an enclosing retainer arranged radially outwardly of the associated stub 18 and 19, respectively. An access passage 23 is provided at one side face 22 of the leg 14 so that the retaining shoulder for the associated stub 19 can pass through the passage, as shown in FIG. 2. A similar passage for the stub 18 is provided in the leg 13.

The hinge leaf 6 has a reinforcing rib 24 extending along its length. It is to be understood that instead of being secured to the closure element 2 by the screws 5, the hinge leaf 6 can alternatively be welded to the closure element.

Transition portions 25 and 26 between the knuckle bearing 7 proper and the axial stubs 18 and 19 are spaced from the base 12 and shielded by protective rims 27 and 28 which are provided on the respective projecting shoulders 20 and 21. As a result of this, it is impossible for the hinge joint to be sawn through in the region of the transition portions 25 and 26, without this damage becoming apparent to those interested.

A bearing sleeve 29 is arranged between the hinge bolt 9, on the one hand, and the knuckle bearing 7 and its axial stubs 18 and 19, on the other hand. The bearing sleeve 29 can be composed of a textile material impregnated with a plastic material.

A closure element 2 with its hinge leaf 6 is shown in FIG. 2 in its closed position by solid lines. In this position an axis 30 of the hinge leaf 6 is inclined. As can be seen from FIG. 2, the closure element 2 and the hinge leaf 6 can be pivoted from this closed position in counterclockwise direction about the vertical hinge joint axis 8 to a limit position which is shown in dash-dot lines in FIG. 2. In this position the closure element 2 extends substantially parallel to the outside wall surface of the container 4. The reinforcing rib 24 fits in the limit position partially into a complementary recess 31 in the base 12 of the hinge bearing. One half of the recess 31 is visible in FIG. 4 from a different view point.

The closure element 2 together with the hinge leaf 6 can be moved in use between two limit positions shown in FIG. 2. The closed closure element 2 with its hinge leaves 6 is secured. Even if without authorization the hinge bolt 9 should be removed from the hinge joint 1, the closure element could still not be removed since then the axial stubs 18 and 19 would strike against the surrounding shoulders 20 and 21. For achieving this security it would be sufficient to provide only one axial stub 19 and the associated shoulder 21. With this vertical arrangement of the hinge joint axis 8, the hinge leaf 6 is supported by the axial stub 19 in the sense of an axial bearing on the leg 14 of the hinge bearing 11.

If now the closure element 2 is to be removed from the container 4, then the hinge bolt 9 is first removed from each associated hinge joint 1. The closure element 2 is then pivoted through a predetermined first pivot angle 32 [see in FIG. 2] whose magnitude is determined in accordance with the construction of the closure element 2 and the container 4. After this pivotal movement, the hinge leaf axis 30 lies in a swiveled position 30'. In this swiveled position a flattest zone 33 of a cam 34 formed on the knuckle bearing 7 lies in the position of closest proximity to an abutment surface 35 on the base 12. A minimum dimension 37 for the knuckle bearing which is smaller than the clearance width of the access passage 23 is defined between the flattest zone 33 of the cam 34 and the diametrically opposite zone 36 on the periphery of the axial stub 18.

If the difference between the size of the passage 23 and the minimum dimension 37 of the knuckle bearing is almost zero, the closure element 2 with its hinge leaves 6 can be removed only through the access passage 23 when the hinge leaf axis is actually in the swiveled position 30'. The greater the above mentioned difference between the two dimensions, the greater is the tolerance angle on each side of the true swiveled position 30' within which fitting or removal of the closure element 2 with its hinge leaves 6 relative to the hinge bearings 11 is possible. Since the fitting or removal position for the closure element 2 is held within quite narrow limits, the operational safety is considerably increased. The operating personnel understand that only in this known fitting or removal position, there is any danger that the closure element 2 can fall out of the hinge bearings 11 if the hinge bolts 9 have been removed unintentionally or by unauthorized personnel. In the same way the closure element 2 can be fitted into place or removed only when it is in this position.

Preferably, the cam 34 extends over the full axial length of the knuckle bearing 7 and is formed so that it is substantially circular. However, it has a radius which decreases toward the flattest zone 33.

FIG. 3 shows the hinge leaf 6 in two positions important for the fitting and the removal of the closure element, in each of these positions the hinge leaf axis 30 is arranged in the swiveled position 30'. The hinge leaf 6 shown at the upper location in FIG. 3 is to be removed from the hinge bearing 11. For this purpose the hinge bolt has already been removed. The hinge leaf 6 is then moved so that the flattest zone 33 comes into contact with the abutment surface 35 on the base 12. Then the flattest zone 33 is moved downwards as viewed in FIG. 3, parallel to the abutment surface 35, until the hinge leaf 6 occupies the lower position shown in broken line in FIG. 3 where it is actually within the access passage 23. Instead of the above right-angle movement during the removal of the hinge leaf 6 from the hinge bearing 11, the longitudinal axis of the knuckle bearing 7 can alternatively be moved along an arcuate path around a quarter of a circle 38 as indicated in FIG. 3. It is to be understood that any other alternative type of movement between these limit positions can also be performed.

The hinge leaf 6 cannot be removed from the hinge bearing 11 even if the hinge bolt 9 has been removed, in all positions on each side of the swiveled position 30', or possibly on each side of a tolerance angle about the true swiveled position 30'. In the above mentioned other pivoted positions, the removal of the hinge leaf 6 from the hinge bearing 11 is prevented either by a rear face 39 of the hinge leaf 6, or by the cam 34 striking against the abutment surface 35 on the one hand, and by the axial stub 18 striking against the bottom edge of the passage 23 as shown in FIG. 2 on the other hand.

Further figures of the drawing show further embodiments of the invention in which the parts corresponding to the parts of the embodiment of FIGS. 1–4 are provided with the same reference numerals.

In the embodiment shown in FIGS. 5 and 6 the bearing sleeve 29 is composed of bearing metal. Additionally, a protective rim corresponding to the protective rim 27 and 28 in the first embodiment is not provided here. FIG. 6 shows by three different positions of the hinge leaf 6 identified with broken lines, that the hinge leaf 6 can be fitted to and removed from the hinge bearing 11 even with a comparatively small first pivot angle as compared with angle 32 in FIG. 2. In this embodiment only the flattest zone 33 of the cam 34 lies at a different circumferential position as compared with that shown in the embodiment of FIGS. 1–4. All other functions of the hinge joint shown in FIGS. 5 and 6 are the same as in the first embodiment.

Figure 7:
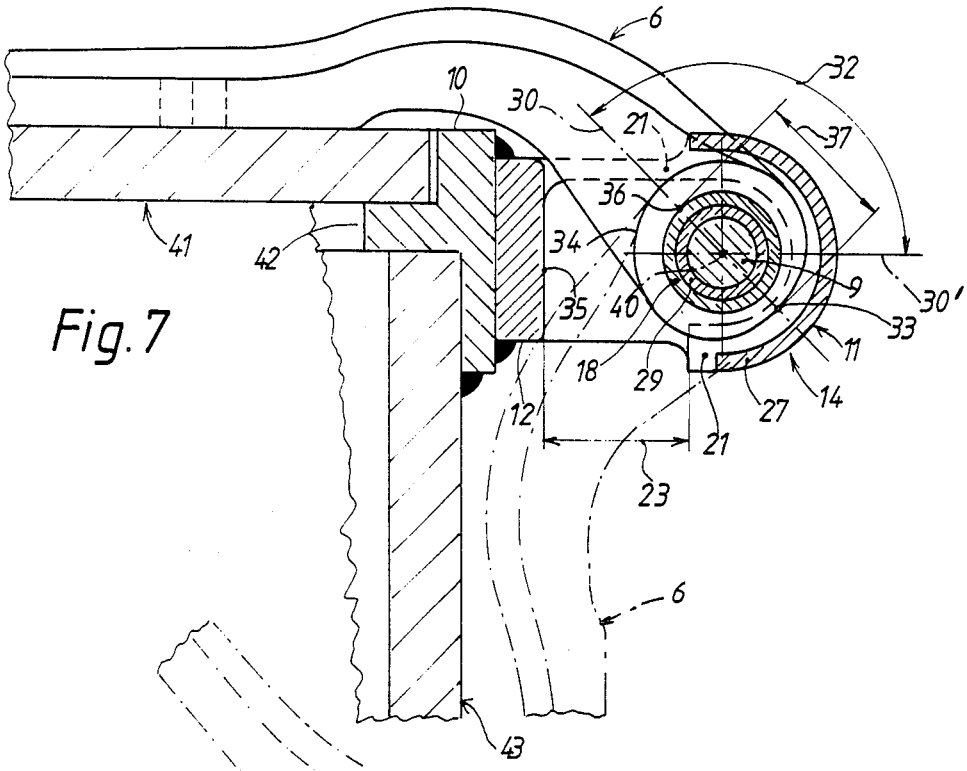
FIG. 7 is a view showing a section of a hinge joint in accordance with a further embodiment of the present invention corresponding to FIG. 2, which in this case has a horizontal hinge joint axis.

The hinge joint in accordance with the embodiment shown in FIGS. 7 and 8 is arranged with its hinge joint axis 40 extending horizontally. The hinge leaves 6 carry a closure element 41 which is formed as a cover for an opening 42 of a holding tank 43. The access passage 23 is located here at the bottom of the hinge bearing 11. The construction and function of the hinge joint in accordance with the embodiment of FIGS. 7 and 8 corresponds to those of the hinge joint of FIGS. 1–4.

Figure 9:
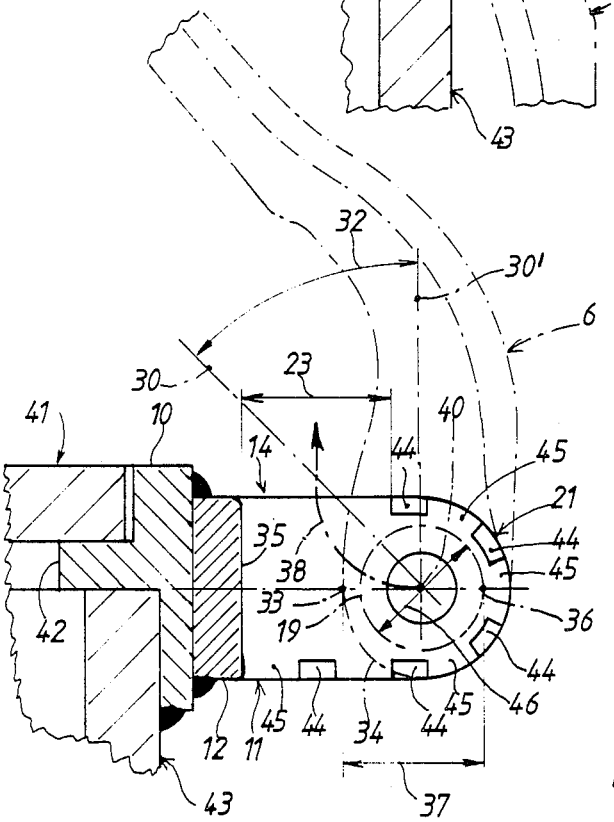
FIG. 9 is a view showing a section corresponding to the section of FIG. 8, but showing a further hinge joint with a hinge bearing having a horizontal hinge joint axis.

In the hinge joint shown in FIG. 9 the hinge bearing 11 does not have a protective rim corresponding to the protective rims 27 and 28 of FIGS. 7 and 8. It is to be understood, however, that in this embodiment such a protective rim can also be provided. In the hinge joint of FIG. 9 the shoulder 21 on the leg 14 has portions 44 which are spaced around the periphery of the leg 14. A peripheral aperture 45 is defined between each pair of adjacent portions 44 and between one of the portions 44 and the abutment surface 35 of the base 12. The width of each peripheral aperture 45 is smaller than a minimum dimension 46 of the axial stub 19, which in the case of FIG. 9 is a minimum diameter. Although the axial stub 19 is visible by any interested person practically about the whole circumference of the leg 14, the axial stub 19 with the hinge bolt 9 removed nevertheless cannot be removed from the hinge bearing 11 unintentionally. To the contrary, the hinge leaf 6 for its removal from the hinge bearing 11 must first be pivoted in the clockwise direction from the closed position which is not shown in FIG. 9 and in which the closure element 41 shown in FIG. 9 closes the opening 42. This pivotal movement brings the axis 30 of the hinge leaf 6 from its closed position into the swiveled fitting and removal position 30'.

The first pivot angle 32 thus traversed is smaller than the first pivot angle 32 required in the hinge joint in accordance with the embodiment of FIG. 7 for the fitting and removal of the hinge leaf 6. However, it is not necessary that the first pivot angle 32 of the hinge joint of FIG. 9 be smaller than that shown in FIG. 7. This is the question of the construction and configuration of the cam 34 as explained hereinabove.

In the hinge joint of FIG. 9 the access passage 23 is provided only at the top of the leg 14, so that the removal of the hinge leaf 6 and consequently of the closure element 41 can take place only upwardly, for example along the quarter of a circle 38. The same is true in the reverse direction for the fitting of the closure element 41 and the hinge leaf 6. In this construction the risk of accidents is reduced in many situations which arise, and the operation of the closure element is facilitated.

Figure 10:
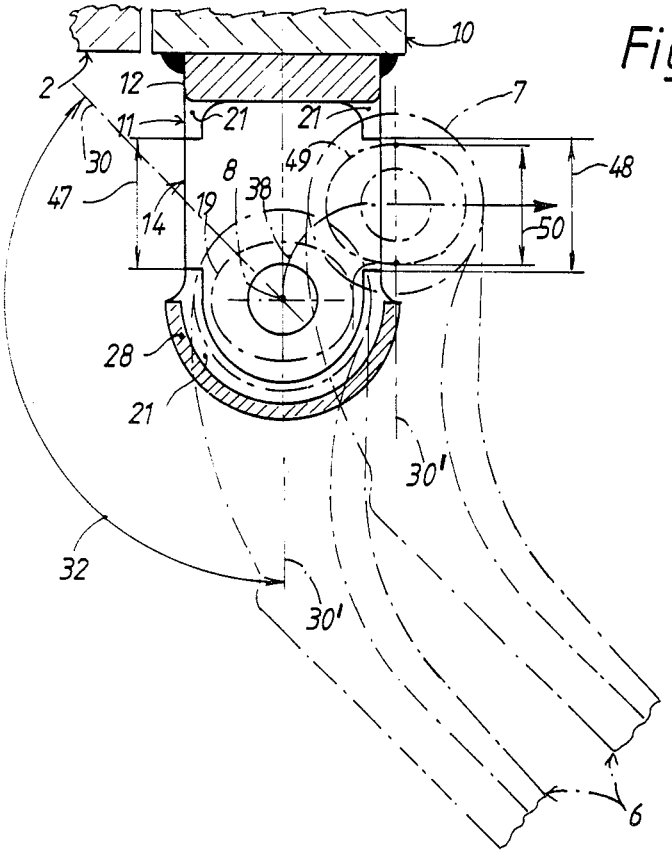
FIG. 10 is a view showing a section corresponding to the section of FIG. 3, but showing another hinge bearing of a hinge joint of the invention with a vertical hinge joint axis.

In the hinge joint of FIG. 10 the hinge bearing 11 which is shown in solid lines has a vertical hinge joint axis 8. It can be also arranged alternatively to have a horizontal hinge joint axis. Two oppositely disposed access passages 47 and 48 are provided in the leg 14 and limited on each side in each case by sections of the shoulder 21. In the hinge joint of FIG. 10 a cam 49 is provided on the axial stub 19. A minimum dimension 50 is defined exclusively by the cam 49 and consequently by the axial stub 19. The closure element 2 is shown in its closed position in which the axis 30 of the hinge leaf 6 lies as shown in FIG. 10. If now the closure element together with the hinge leaf 6 is pivoted through the first pivot angle 32 in counterclockwise direction, the axis moves into the swiveled position 30'. In this swiveled position shown in broken lines, the hinge leaf 6 can be removed from the hinge bearing 11 either through the access passage 47 or through the access passage 48, for example by following the quarter of a circle 38.

Alternatively, a larger or smaller first pivot angle 32 can be used. However, in this case the cam 49 would have to be correspondingly arranged on the hinge leaf 6 in such a manner that in the fitting and removal positions the minimum dimension 50 lies at least approximately parallel to the relevant passage 47 or 48.

In the hinge joint shown in FIG. 10 one of the access passages 47 and 48 can be made not passable for the cam 49. For this purpose the shoulder 21 can be made continuous, or an element corresponding to the portions 44 of FIG. 9 can be added. On the other hand, the legs 13 and 14 in all embodiments described earlier can alternatively be equipped with two oppositely arranged access passages corresponding to the passages 47 and 48 in FIG. 10. In the hinge joint shown in FIG. 10, the knuckle bearing 7 of the hinge leaf 6 never comes into contact with the base 12 of the hinge bearing 11.

It will be understood that each of the elements described above, or two or more together, may also find a useful application in other types of constructions differing from the types described above.

While the invention has been illustrated and described as embodied in a hinge joint, particularly for closure elements, such as doors and lids, it is not intended to be limited to the details shown, since various modifications and structural changes may be made without departing in any way from the spirit of the present invention.

Without further analysis, the foregoing will so fully reveal the gist of the present invention that others can, by applying curren knowledge, readily adapt it for various applications without omitting features that, from the standpoint of prior art, fairly constitute essential characteristics of the generic or specific aspects of this invention.

What is claimed as new and desired to be protected by Letters Patent is set forth in the claims:

1. A hinge joint, comprising a hinge leaf which is securable to a closure element and has a knuckle bearing; a hinge bolt defining a hinge joint axis and pivotally mounting said closure element via said knuckle bearing; a hinge bearing having a base securable adjacent to an edge of an opening, said hinge bearing having legs between which said knuckle bearing is positioned and which carry said hinge bolt, said knuckle bearing having at least one first protrusion extending axially outwardly and arranged concentrically relative to said hinge bolt, at least one of said legs having an axially inwardly extending second protrusion which axially overlaps said first protrusion, said hinge leaf together with said closure element being arranged so that it can be removed from said hinge bearing only after removal of said hinge bolt and after opening said closure element through a predetermined first pivot angle, said at least one first protrusion being annular, said at least one second protrusion being formed as an enclosing retainer of an associated one of said legs and arranged radially outside of an associated one of said first protrusions, said enclosing retainer at at least one side face of said leg being provided with an access passage for said at least one first protrusion; and cam means provided on said hinge leaf, so that only in a pivoted position of said closure element corresponding to said predetermined first pivot angle there is a minimum dimension of said cam means extending perpendicular to said hinge joint axis with said hinge bolt removed, so that the passage of said at least one first protrusion through an associated one of said access passages is possible.

2. A hinge joint as defined in claim 1, wherein said cam means includes a cam arranged on said knuckle bearing, said base of said hinge bearing having an abutment surface with which said cam cooperates, so that in the pivoted position of said closure element corresponding to said predetermined first pivot angle the minimum dimension defined by the cam and said first protrusion is arranged to be at least approximately parallel to said access passage.

3. A hinge joint as defined in claim 1, wehrein said cam means includes a cam arranged on said at least one first protrusion so that in the pivoted position of said closure element corresponding to said predetermined first pivot angle the minimum dimension defined by said cam is arranged to be at least approximately parallel to said access passage.

4. A hinge joint as defined in claim 1, wherein with said hinge bolt arranged in said legs of said hinge bearing at least a peripheral zone, remote from said base of said hinge bearing, of a transition portion from said knuckle bearing to said at least one first protrusion is shielded by a protective rim arranged on said enclosing retainer.

5. A hinge joint as defined in claim 1, wherein when said hinge bolt is inserted in said legs of said hinge bearing a spacing is formed between said hinge joint axis and said base of said hinge bearing, said spacing being greater than said minimum dimension.

6. A hinge joint as defined in claim 1, and further comprising a bearing sleeve provided between said hinge bolt, and said knuckle bearing with said at least one first protrusion.

7. A hinge joint as defined in claim 1, wherein said access passages on a respective one of said legs of said hinge bearing is formed so that when said hinge joint axis extends horizontally, said access passage is open only upwardly.

8. A hinge joint as defined in claim 1, wherein said enclosing retainer is formed as a continuous member.

9. A hinge joint as defined in claim 1, wherein each of said enclosing retainers has at least two portions provided on said second protrusion so that peripheral apertures are defined by said portions at a periphery of a respective one of said legs, said peripheral apertures each having such a width which is smaller than a minimum dimension of a respective one of said first protrusions perpendicular to said hinge joint axis.

* * * * *